US005243773A

United States Patent [19]

Robic

[11] Patent Number: 5,243,773

[45] Date of Patent: Sep. 14, 1993

[54] SKI BOOT WITH SHOCK-ABSORBING SOLE

[75] Inventor: Andrej Robic, Radovljica, Yugoslavia

[73] Assignee: "ALPINA" tovarna obutve, p.o., Ziri, Yugoslavia

[21] Appl. No.: 625,652

[22] Filed: Dec. 12, 1990

[30] Foreign Application Priority Data

Dec. 15, 1989 [YU] Yugoslavia ..... 2386/89

[51] Int. Cl.[5] ..... A43B 5/04; A43B 13/18

[52] U.S. Cl. ..... 36/117; 36/132; 36/28

[58] Field of Search ..... 36/117, 15, 30 R, 100, 36/132

[56] References Cited

U.S. PATENT DOCUMENTS

| | | | |
|---|---|---|---|
| 1,659,339 | 2/1928 | Vetterling | 36/28 |
| 1,693,911 | 12/1928 | Schmeer | 36/28 X |
| 1,994,681 | 3/1935 | Blumenfeld | 36/28 X |
| 3,228,122 | 1/1966 | Ludwig | 36/117 |
| 3,957,280 | 5/1976 | Turnheim et al. | 36/117 X |
| 4,351,120 | 9/1982 | Dalebout | 36/117 |
| 4,937,955 | 7/1990 | Bonaventure | 36/117 X |
| 5,054,213 | 10/1991 | Bonaventure | 36/117 |
| 5,086,575 | 2/1992 | Bonaventure | 36/117 |

FOREIGN PATENT DOCUMENTS

| | | | |
|---|---|---|---|
| 0016761 | 4/1984 | Japan | 36/117 |
| 172710 | 9/1933 | Switzerland | 36/117 |
| 462668 | 10/1968 | Switzerland | 36/117 |
| 19334 | of 1904 | United Kingdom | 36/28 |

*Primary Examiner*—Steven N. Meyers
*Assistant Examiner*—BethAnne Cicconi
*Attorney, Agent, or Firm*—Keck, Mahin & Cate

[57] ABSTRACT

The invention refers to a ski boot, on the outside and in longitudinal direction of an insole 2 comprising a pair of L-shaped guides 5, 6 into which outsoles 7, 10 are inserted. Between the insole 2 and the outsoles 7, 10 there is arranged, preferably glued, a rubber dampening plate 20 which is at its both end parts provided with extensions 21, 22 perpendicular thereto. The outsoles 7, 10 are joined with the insole 2 in a manner that inbetween in the area of the midlength there is provided a space into which a rubber extension 19 is slitlessly inserted perpendicularly to the sole of the boot. In longitudinal direction of the ski boot the semicircular toe part of the outsole 7 and the semicircular heel part of the outsole 10 are spaced from each guide 5, 6 whereby in these spacings there are slitlessly arranged rubber dampening extensions 23, 24, 25, 26 which are aligned with the plane of the outer surface of the second leg of each guide 5,6.

7 Claims, 6 Drawing Sheets

SKI BOOT WITH SHOCK-ABSORBING SOLE

The present invention relates to a ski boot, and in particular to a ski boot with a shell whereto an outsole is connected for dampening the impacts between a ski and a skier.

At skiing, especially at competition and particularly at downhill skiing, the skier is due to micro- and macro-unevenness of the snow ground exposed to relatively strong impacts which in extreme cases are so strong that the skier's joints and spine are exposed to overloadings which, in extreme cases, lead to serious body injuries.

Several solutions for dampening the impacts between a ski and a skier are known. One of them (known as DERBYFLEX plate) comprises a rubber base covered by an aluminium plate which is fixed onto the ski in the standing area of the skier and which dampens the impacts occurring at skiing. A disadvantage of said solution lies in the weight of the ski which increases considerably due to arranging said plate thereon and, besides, the standing height of the skier raises due to the thickness of said plate wherefore it is relatively difficult to keep the skis under inclination with respect to the ground at the winding movement thereof.

The aim of the invention is to provide a ski boot of the general class discussed in the foregoing, which, however, will provide effective dampening between the ski and the skier whereby the deflection curve of the ski remains unchanged.

According to the present invention the object is achieved by means of features described in the characterizing clause of claim 1. Further details of the solution according to the invention are described in the subclaims.

Figure 2:
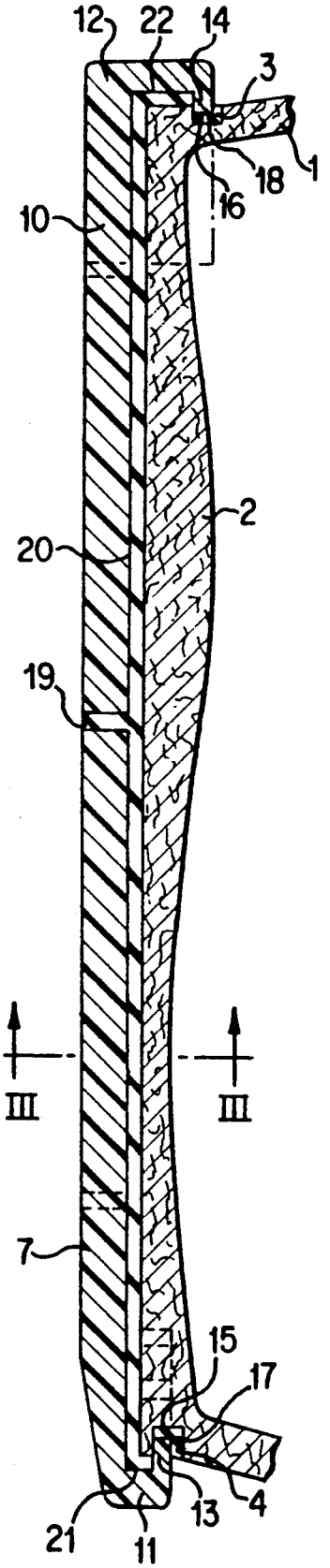
Figure 1:
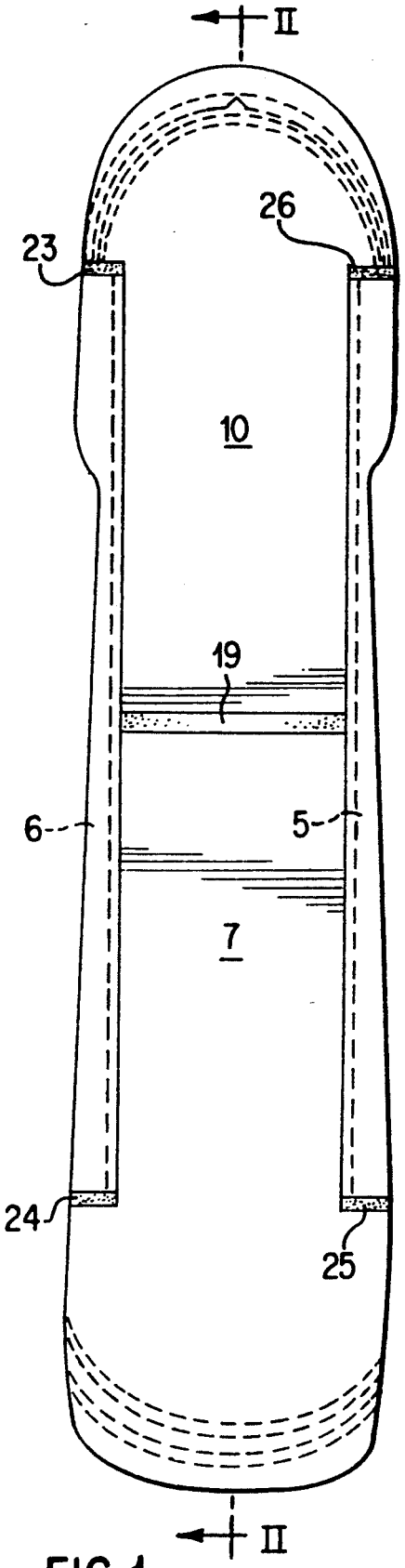
Figure 3:
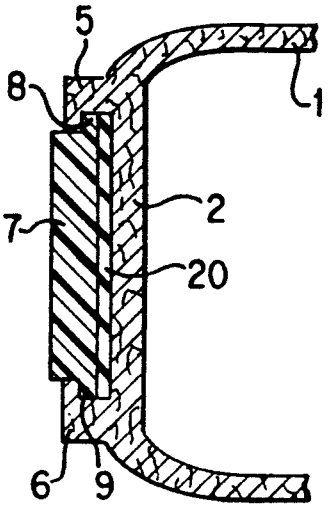
Figure 5:
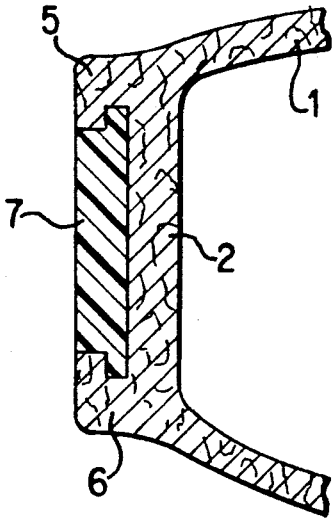
Figure 4:
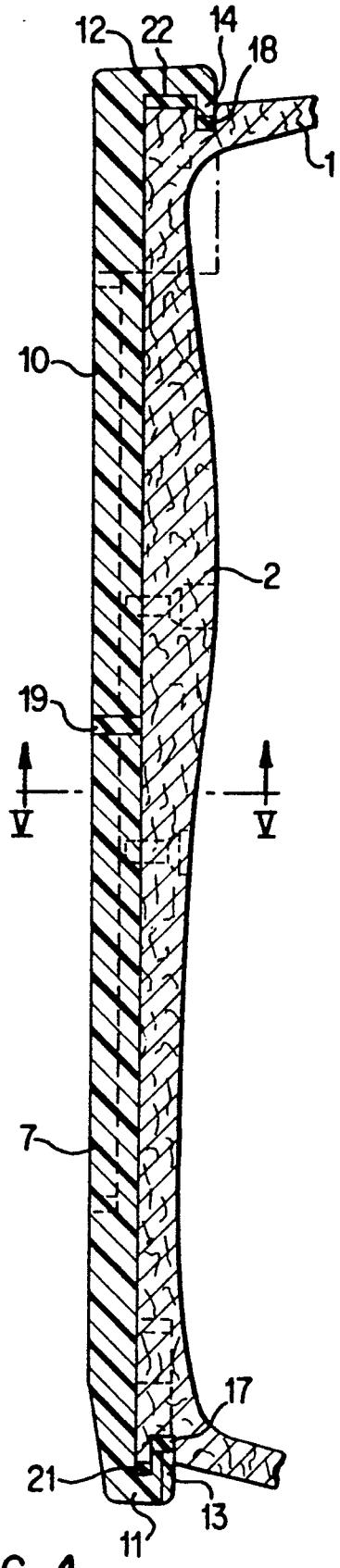
Figure 8:
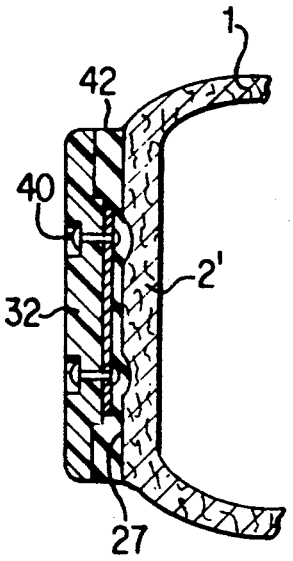
Figure 7:
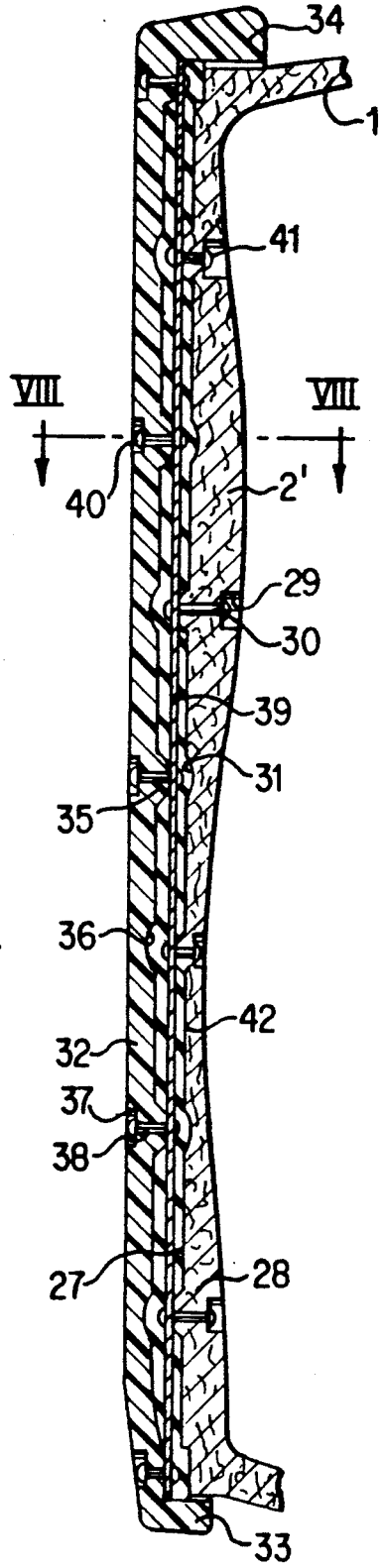
Figure 6:
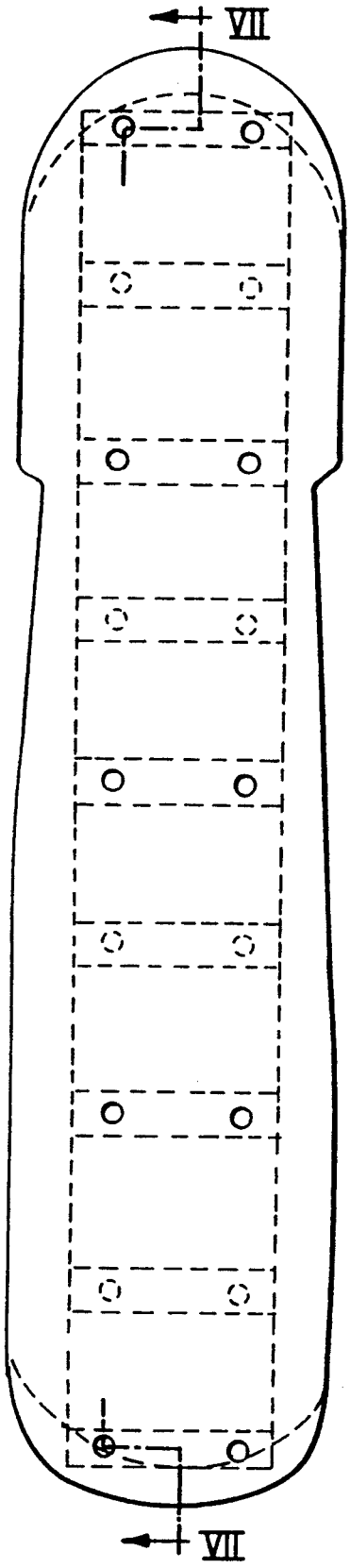
Figure 11:
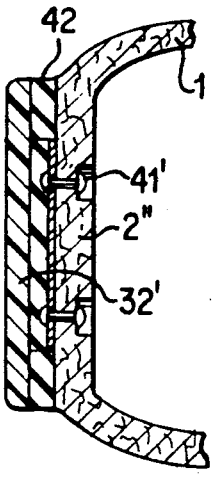
Figure 10:
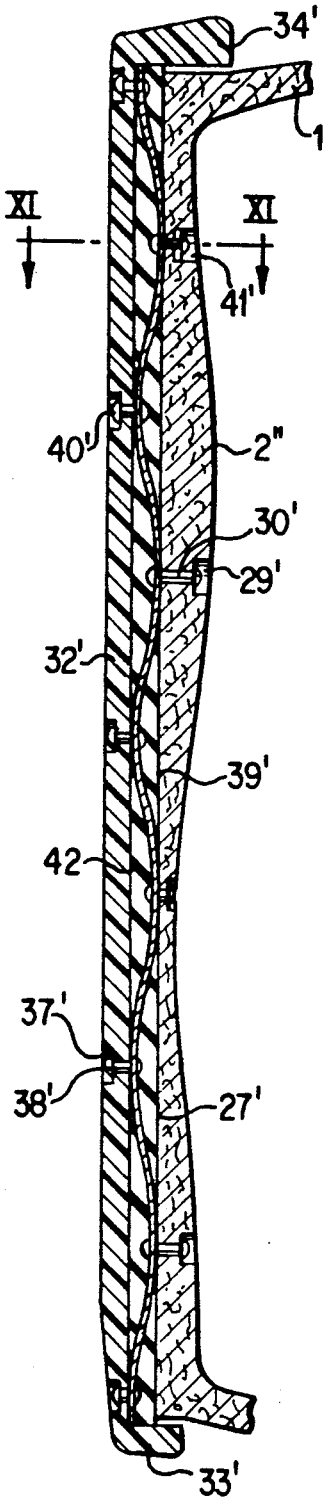
Figure 9:
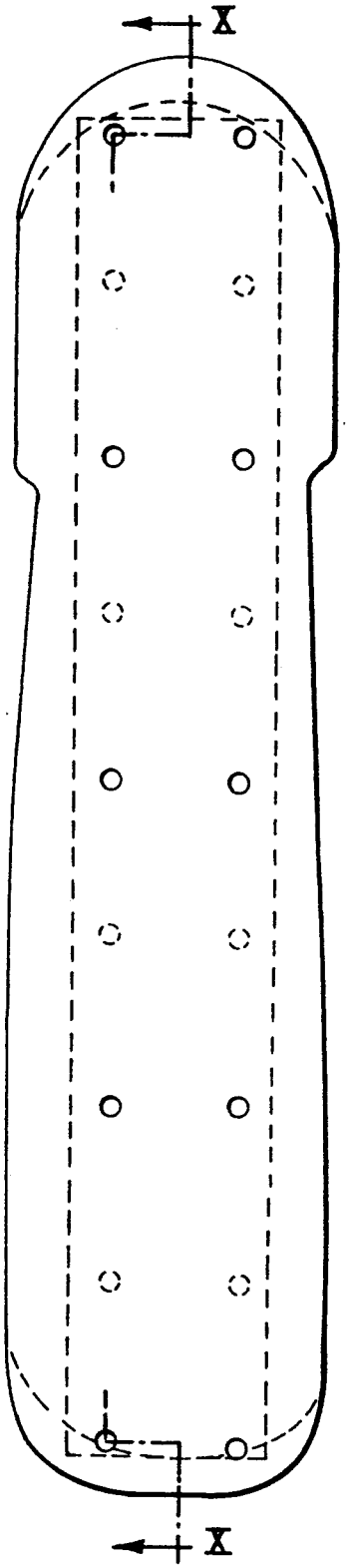
Figure 14:
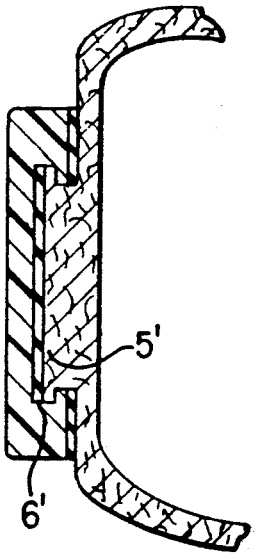
Figure 13:
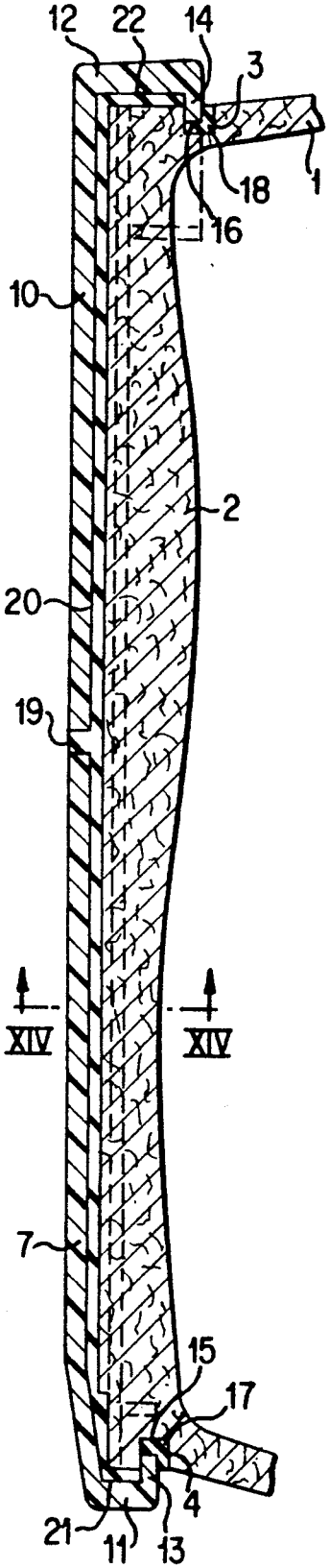
Figure 12:
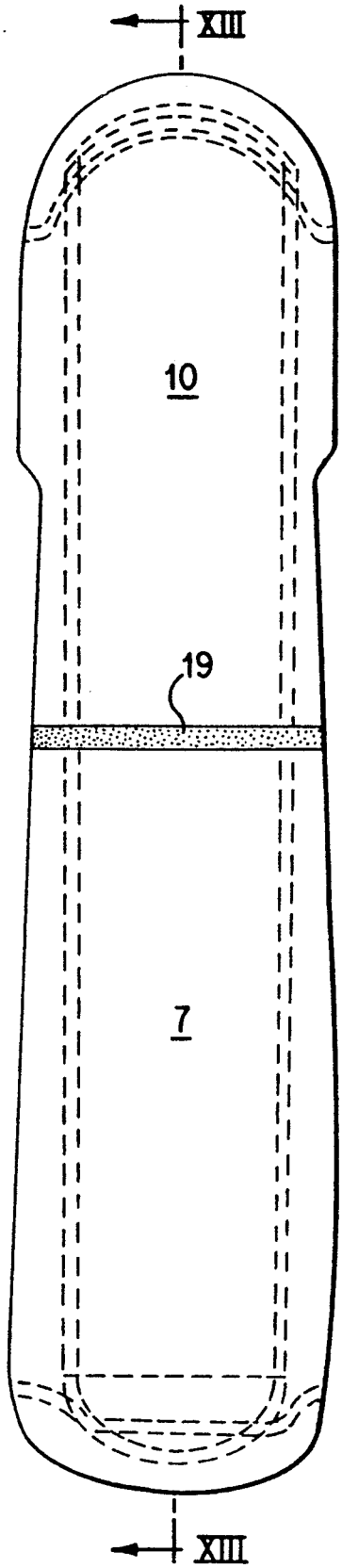
Figure 16:
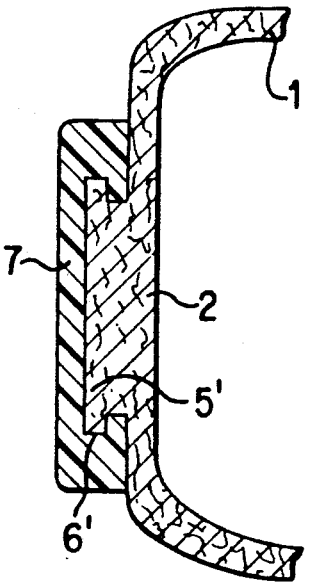
Figure 15:
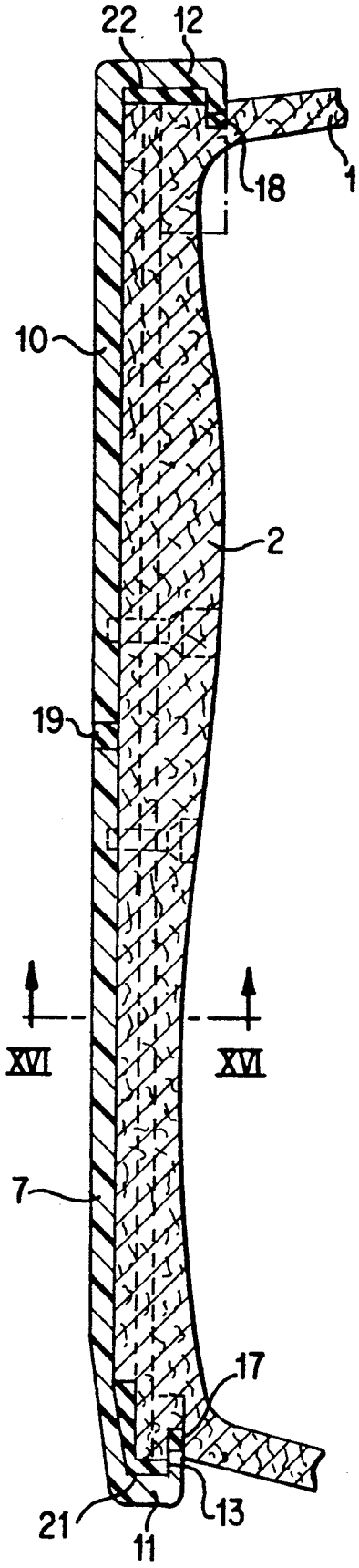

The invention will now be disclosed on the basis of examples of embodiment with reference to the accompanying drawings. Therein show:

FIG. 1 a view of an outsole of a ski boot according to the invention from the standing side, FIG. 2 a sectional view taken along the line II—II of FIG. 1, FIG. 3 a sectional view taken along the line III—III of FIG. 2, FIG. 4 a view as in FIG. 2 in another embodiment, FIG. 5 a sectional view taken along the line V—V of FIG. 4, FIG. 6 a view as in FIG. 1 in another embodiment, FIG. 7 a sectional view taken along the line VII—VII of FIG. 6, FIG. 8 a sectional view taken along the line VIII—VIII of FIG. 7, FIG. 9 a view as in FIG. 1 in another embodiment, FIG. 10 a sectional view taken along the line X—X of FIG. 9, FIG. 11 a sectional view taken along the line XI—XI of FIG. 10, FIG. 12 a view as in FIG. 1 in another embodiment, FIG. 13 a sectional view taken along the line XIII—XIII of FIG. 12, FIG. 14 a sectional view taken along the line XIV—XIV of FIG. 13, FIG. 15 a view as in FIG. 13 in another embodiment, FIG. 16 a sectional view taken along the line XVI—XVI of FIG. 15.

A ski boot according to the invention (FIGS. 1, 2, 3) comprises a shell 1, partially shown in the drawing, whereto is connected an insole 2. In the area of each front connection of the shell 1 and the insole 2 the boot is from the outside provided with a rectangular channel 3, 4 running in parallel to the insole 2. The latter is on the side averted from the shell 1 and along its both longer sides integral with L-shaped guides 5, 6 extending to the area of both, i.e. the heel and the toe part of the ski boot. Moreover, the first leg of each guide 5, 6 is integral with the insole 2 and the second leg thereof is turned inside, i.e. the second legs are turned to each other forming a guide of T-shape. From the toe side the first outsole 7 of T-shape cross-section is inserted into said T-guide, i.e. into the guides 5, 6, the sole of which reaches over the area of the second leg of each guide 5, 6. The outsole 7 comprises a pair of longitudinal projections 8, 9 which in installed state adjoin the inner side of the second legs of each guide 5, 6. Furthermore, from the heel side the second outsole 10 of also T-shape cross-section is inserted into the said T-guide, the sole of which reaches over the area of the second leg of each guide 5, 6 as it does at the outsole 7. The outsole 10 like the outsole 7 comprises a pair of longitudinal projections not shown in the drawing, adjoining the inner side of the both second legs.

At their ends turned to the heel and to the toe part of the ski boot, respectively, the outsoles 7, 10 are provided with webs 11, 12 which essentially have the form of a semi-circle standing rectangularly to each outsole 7, 10 and turned to the shell 1, said webs extending to the area of the channels 3, 4 and serving for fixing the ski boot into the binding which is not shown. At the end averted from each outsole 7, 10 the webs 11, 12 each time comprise a pair of teeth 13, 14 being parallel to said outsole and meshing the channels 3, 4. The teeth 13, 14 in no case contact the bottom 15, 16 of the channel 3, 4. That part of each channel 3, 4 which is not occupied by the tooth 13, 14 is filled up by means of a rubber filling 17, 18 to which pressure is exerted by each tooth 13, 14. The outsoles 7, 10 are joined with the insole 2 in a manner that in-between in the area of the midlength there is a space into which a rubber extension 19 is inserted slitlessly and rectangularly in accord with the sole of the ski boot. On the level said extension flushes with the sole of each outsole 7, 10. Between the insole 2 and the outsoles 7, 10 there is slitlessly arranged, preferably glued, a rubber dampening plate 20, on its both end parts provided with extensions 21, 22 being rectangular thereon. Said extensions are slitlessly placed at the assembled sole of the ski boot between the webs 11, 12 and each heel and toe corner area, respectively, in the point of contact of the shell 1 and the insole 2.

In longitudinal direction of the ski boot the semicircular toe part of the outsole 7 and the semicircular heel part of the outsole 10 are spaced from each guide 5, 6 whereby in these spacings there are slitlessly arranged rubber dampening extensions 23, 24, 25 26 which are aligned with the plane of the outer surface of the second leg of each guide 5, 6. The outsoles 7, 10 are in known manner, not shown in the drawing, secured against unmesh with the guides 5, 6.

A further embodiment of the ski boot according to the invention (FIGS. 12, 13, 14) is essentially equal to the aforementioned one. The only difference lies in that the T-shaped groove joint between the insole 2 and the outsoles 7, 10 is formed in a manner that the outsoles 7, 10 are in cross-section formed by means of essentially T-shaped groove 6' meshing with a guide 5' being T-shaped in cross-section and formed on the outer part of the insole 2 and in the longitudinal direction thereof. All other details are evident from the description of the aforementioned embodiment of the ski boot.

The ski boot according to the invention functions in the following manner. At fixing the ski boot into ski bindings the outsoles 7, 10 tend to move one towards another in longitudinal direction due to compressibility of the rubber fillings 17, 18 and the extensions 19, 21, 22, 23, 24, 25, 26. Impacts in the direction perpendicular to the ski boot which occur during skiing are dampened by means of the rubber dampening plate 20, thus only a small portion of impacts is transmitted onto the skier. During skiing there also take place deflections of the ski and thus changes of the length between the ski bindings whereupon a ski boot could spring off the grip thereof. This is prevented by means of rubber extensions 19, 21, 22, 23, 24, 25, 26 enabling longitudinal displacement of the outsoles 7, 10 in respect to the ski boot and thus enabling variable clearance between the ski bindings and reliable gripping of the ski boot at the same time.

A further embodiment of the ski boot according to the invention (FIGS. 4, 5) differs from the aforementioned one in that in-between the insole 2 and the outsoles 7, 10 inserted into the guides 5, 6 there is no rubber dampening plate 20. In this embodiment the outsoles 7, 10 are in alignment with the outer surface of each second leg of the L-shaped guide 5, 6.

The embodiment shown in FIGS. 15, 16 differs from the previous one in that the T-shaped groove joint between the insole 2 and the outsoles 7, 10 is formed in a manner that both outsoles 7, 10 have a cross-section formed essentially as a T-shaped groove 6' into which a guide 5' of T-shape in cross-section meshes, said guide being formed on the outer part of the insole 2 and in longitudinal direction thereof.

The two embodiments of the ski boot according to the invention as represented in FIGS. 4, 5, 15, 16 are capable of dampening only possible impacts in longitudinal direction of the ski boot, and enable variation of clearance between the bindings, respectively, without any danger of releasing thereof.

Another embodiment of the ski boot according to the invention is shown in FIGS. 6, 7, 8. This embodiment comprises a shell 1 integral with the insole 2' which is from its outside formed by means of essentially flat outer surface 27. The latter is in cross-section of the ski boot formed with a number of trapezoidal protrusions 28 of the same height being mutually equally spaced along the boot. From the inside of the boot and in the area above each protrusion 28 the insole 2' is formed by means of at least one row of cylindrical depressions 29. Through-holes 30 are formed centrically through the bottom of said depressions 29. In each interspace of two adjoining protrusions 28 the surface 27 is provided with a row of circular hollows 31.

With its outer surface 27 the insole 2' is placed on an essentially flat outsole 32 which is at each end provided with a pair of semicircular extensions 33, 34 perpendicular thereto and serving for fixing into the bindings not shown. On the side turned to the insole 2' and in the area below the circular hollows 31 the outsole 32 is transversal to the longitudinal direction of the boot provided with a row of mutually equally spaced trapezoidal protrusions 35 of the same height. In each interspace of the two adjoining protrusions 35 the outsole 32 is formed by means of a row of circular hollows 36 arranged precisely below each protrusion 28. From the side averted from the insole 2' and in the area below each protrusion 35 the outsole 32 is provided with at least one row of cylindrical depressions 37. Through-holes 38 are formed centrically through the bottom of said depressions 37. On the peaks of the protrusions 35 of the outsole 32 there is placed a flexible metal strip 39 fixed to the outsole 32 with fixing means 40, preferably rivets, which pierce the outsole 32 through the holes 38. The metal strip 39 extends over the entire length of the outsole 32, between the extensions 33, 34. Furthermore, the metal strip 39 is fixed to the insole 2' with fixing means 41, preferably rivets, which pierce the insole 2' through the holes 30. Thus, the metal strip 39 rests on the peaks of protrusions 28 of the insole 2'. On the side of fixation of the strip 39 the heads of the rivets 40, 41 are each time arranged precisely under the circular hollows 31, 36. All remaining interspace between the insole 2' and the outsole 32 is filled, preferably die-cast, by means of elastic synthetic resin 42, preferably synthetic rubber.

FIGS, 9, 10, and 11 show a further embodiment of the ski boot according to the invention. The shell 1 of this embodiment is integral with an insole 2" which is on its outer side, i.e. the side averted from the shell 1, provided with a flat outer surface 27'. From its inner side the insole 2" is formed by means of at least one row of cylindrical depressions 29' perpendicular to the surface 27' whereby through-holes 30' are centrically formed through the bottom of said depressions 29'. From its side averted from the insole 2" the outsole 32' is provided with at least one row of cylindrical depressions 37' perpendicular thereto, whereby through-holes 38' are centrically formed through the bottom thereof. Furthermore, at each end the outsole 32' is provided with essentially semicircular extensions 33', 34' perpendicular thereto and serving for fixing into the bindings not shown.

On the side of the outsole 32' turned towards the insole 2" there is placed an essentially sinusoidal flexible metal strip 39' which is fixed to the outside 32' by means of fixing means 40', preferably rivets, piercing the insole 2" through the holes 38'. Said fixing means hold the metal strip 39' at the bottom of each minimum of sinusoid. On the peaks of the sinusoidal metal strip 39' there rests the insole 2" which is fixed thereto by means of fixing means 41', preferably rivets, piercing the insole 2" through the holes 30'.

All remaining interspace between the insole 2" and the outsole 32' is filled, preferably die-cast, by means of elastic synthetic resin, preferably synthetic rubber.

The two embodiments of the ski boot according to the invention as represented in FIGS. 6 to 11 enable only dampening of the impacts in the direction perpendicularly to the boot, for the flexible metal strip 39 formed essentially as a plane beam and the flexible metal strip 39' formed essentially as a curvilinear beam, respectively, are supported and fixed on a row of supports allowing only displacements of this kind.

What is claimed is:

1. A ski boot comprising a shell and an outsole connected thereto, wherein an insole (2) and a plurality of portions of said outsole (7, 10) are joined by a rubber dampening plate (20) adhered between facing surfaces of said insole and said outsole portions, said rubber dampening plate comprising a T-shaped portion in a region of facing end surfaces of said outsole portions, said rubber dampening plate further comprising end portions (21, 22) extending substantially perpendicular thereto in a direction away from the outsole.

2. A ski boot according to claim 1, wherein said outsole portions (7, 10) are joined with the insole (2) by a rubber portion (19) inserted in a space between said outsole portions extending in a width direction in an intermediate portion of the ski boot.

3. A ski boot according to claim 1, wherein a semicircular toe part of the outsole portion (7) and a semicircular heel part of the outsole portion (10) are, in a longitudinal direction of the ski boot, each spaced from a guide (5, 6) wherein rubber dampening extensions (23, 24, 25, 26) are disposed in said spaces aligned with the plane of an outer surface of a second leg of each guide (5, 6).

4. A ski boot according to claim 1, wherein the outsole (7, 10) is movable in a longitudinal direction to the insole (2).

5. A ski boot according to claim 1, wherein the outsole (7, 10) is movable perpendicularly to the insole (2).

6. A ski boot according to claim 4, wherein the outsole (7, 10) is movable perpendicularly to the insole (2).

7. A ski boot according to claim 2, wherein a semicircular toe part of the outsole portion (7) and a semicircular heel part of the outsole portion (10) are, in a longitudinal direction of the ski boot, each spaced from a guide (5, 6) wherein rubber dampening extensions (23, 24, 25, 26) are disposed in said spaced aligned with the plane of an outer surface of a second leg of each guide (5, 6).

* * * * *